US009511978B2

(12) United States Patent
Mielonen et al.

(10) Patent No.: US 9,511,978 B2
(45) Date of Patent: Dec. 6, 2016

(54) INTEGRATED ROOF STRUCTURE OF AN ELEVATOR CAR

(71) Applicant: KONE CORPORATION, Helsinki (FI)

(72) Inventors: Juha Mielonen, Vantaa (FI); Matti Räsänen, Hyvinkää (FI); Nithil Karimpanackal Natarajan, Helsinki (FI); Osmo Björni, Hyvinkää (FI); Paula Bello, Helsinki (FI); Razvan Albu, Vantaa (FI); Timo Manner, Klaukkala (FI); Tuuli Somma, Helsinki (FI)

(73) Assignee: KONE CORPORATION, Helsinki (FI)

( * ) Notice: Subject to any disclaimer, the term of this patent is extended or adjusted under 35 U.S.C. 154(b) by 754 days.

(21) Appl. No.: 13/858,193

(22) Filed: Apr. 8, 2013

(65) Prior Publication Data

US 2013/0220742 A1 Aug. 29, 2013

Related U.S. Application Data

(63) Continuation of application No. PCT/FI2011/050839, filed on Sep. 28, 2011.

(30) Foreign Application Priority Data

Oct. 11, 2010 (FI) ..... 20106044

(51) Int. Cl.
*B66B 11/02* (2006.01)

(52) U.S. Cl.
CPC ..... *B66B 11/0246* (2013.01); *B66B 11/024* (2013.01); *B66B 11/0206* (2013.01); *B66B 11/0226* (2013.01); *B66B 11/0233* (2013.01)

(58) Field of Classification Search
CPC .. B66B 11/0246; B66B 11/0233; B66B 9/187; B66B 11/024; B66B 11/0206
(Continued)

(56) References Cited

U.S. PATENT DOCUMENTS 4,875,553 A * 10/1989 Smith ..... B66B 11/0253 187/401
5,025,895 A * 6/1991 Leone ..... B66B 5/0031 187/277
(Continued)

FOREIGN PATENT DOCUMENTS

CN 1471492 A 1/2004
CN 1872649 A 12/2006
(Continued)

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

An elevator includes an elevator hoistway with an elevator car arranged to move therein. The elevator car includes an interior bounded by at least the elevator care roof. A frame structure includes two parallel, horizontal, elongated roof beams that are at a horizontal distance from each other. Between the roof beams is a trough that has an upward-facing base surface, and a standing platform in connection with the roof of the elevator car that includes a standing surface, immediately above which is a space free of the parts of the elevator car and free of the ropes of the elevator, for enabling standing on top of the standing surface at least when the elevator car is situated at a distance from the top end of the elevator hoistway. The standing surface forms at least a part of the base surface of the trough.

25 Claims, 4 Drawing Sheets

Figure 1:
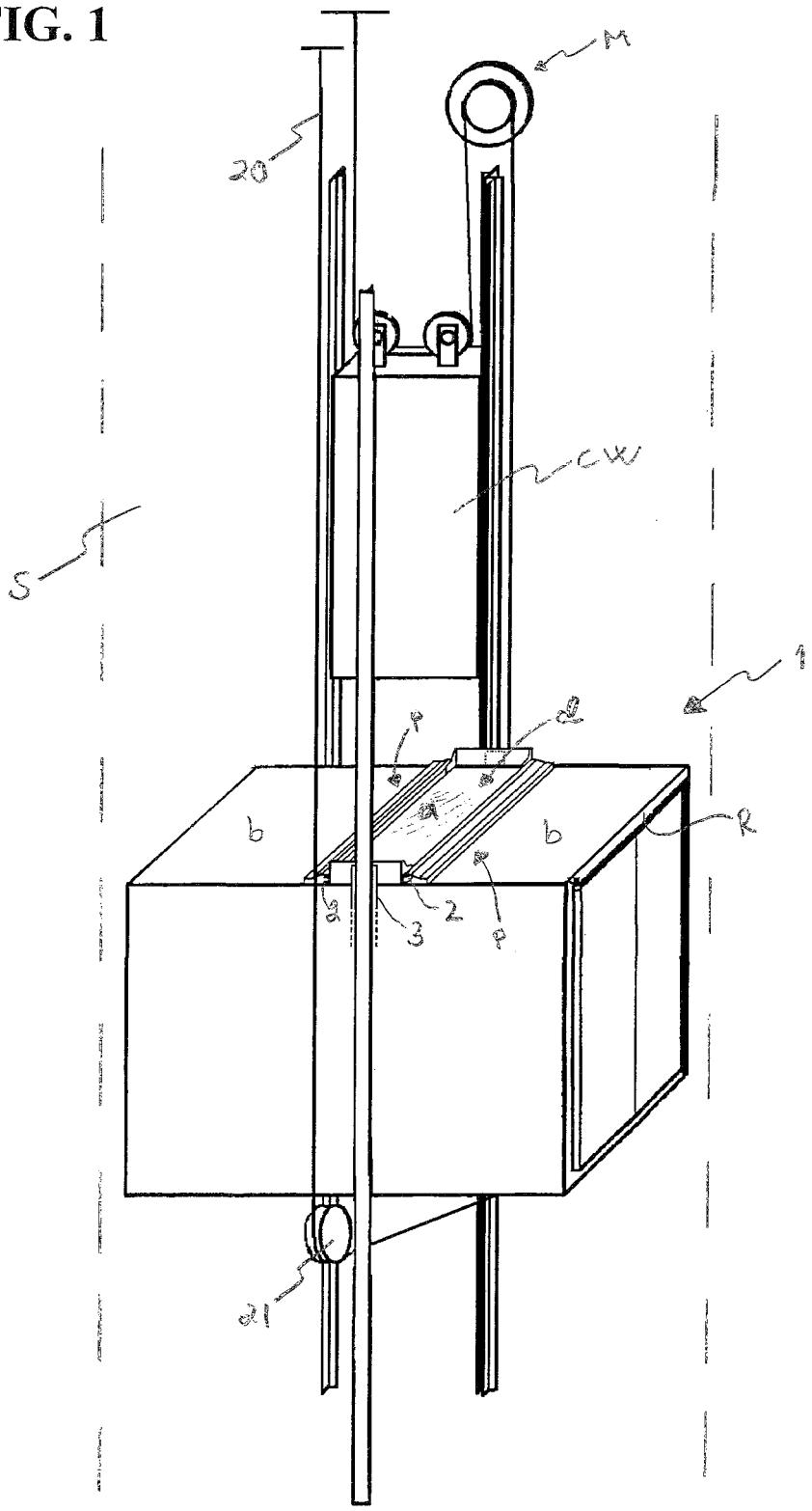

(58) Field of Classification Search
IPC ..... B66B 11/02
See application file for complete search history.

(56) References Cited

U.S. PATENT DOCUMENTS

| | | | | |
|---|---|---|---|---|
| 5,957,243 | A | 9/1999 | Root et al. | |
| 6,202,801 | B1 | 3/2001 | Muller et al. | |
| 7,625,097 | B2 * | 12/2009 | Endo | B66B 11/0233 313/485 |
| 7,665,582 | B2 * | 2/2010 | Lindh | B66B 9/187 182/2.1 |
| 2004/0195049 | A1 * | 10/2004 | Stobo | B66B 11/0253 187/401 |
| 2007/0251767 | A1 * | 11/2007 | Yoon | B66B 11/0226 187/401 |
| 2010/0200339 | A1 * | 8/2010 | Henseler | B66B 11/0246 187/401 |

FOREIGN PATENT DOCUMENTS

| | | | | | |
|---|---|---|---|---|---|
| CN | 101119920 | A | | 2/2008 | |
| CN | 201250039 | Y | | 6/2009 | |
| EP | 1422185 | A1 | | 5/2004 | |
| EP | 1698581 | A1 | | 9/2006 | |
| EP | 1970341 | A1 | | 9/2008 | |
| FR | 1174381 | A1 | * | 1/2002 | B66B 11/002 |
| JP | 52039235 | A | * | 3/1977 | |
| JP | 2000-289953 | A | | 10/2000 | |
| JP | 2001039654 | A | * | 2/2001 | |
| JP | 2004107047 | A | * | 4/2004 | |
| JP | 2005145619 | A | * | 6/2005 | |
| JP | WO 2007091292 | A1 | * | 8/2007 | B66B 5/027 |
| JP | 2008007216 | A | * | 1/2008 | |
| JP | 2008013328 | A | * | 1/2008 | B66B 11/02 |
| JP | 2011093618 | A | * | 5/2011 | B66B 11/02 |
| JP | 2011190059 | A | * | 9/2011 | B66B 11/02 |
| WO | WO 99/33743 | A1 | | 7/1999 | |

* cited by examiner

INTEGRATED ROOF STRUCTURE OF AN ELEVATOR CAR

CROSS REFERENCE TO RELATED APPLICATIONS

This non-provisional application is a Continuation of International Application No. PCT/FI2011/050839 filed on Sep. 28, 2011, which claims the benefit of Patent Application No. 20106044 filed in Finland on Oct. 11, 2010. The entire contents of all of the above applications are hereby incorporated by reference.

FIELD OF THE INVENTION

The object of the invention is an elevator, more particularly an elevator applicable to the transporting of people and/or of freight.

BACKGROUND OF THE INVENTION

Elevator cars are conventionally formed to comprise a load-bearing frame structure, i.e. a car sling, which comprises a lower horizontal beam system and an upper horizontal beam system, as well as a vertical beam system of a first side and a vertical beam system of a second side, which beam systems are connected to each other so that they form a closed loop, inside which loop is an interior comprised in a car box fixed to the beam systems, which interior can receive goods and/or passengers for conveying them in the interior of the elevator car. Conventionally the car box has been essentially fully inside the aforementioned loop. Also known in the art are elevator cars, in which the vertical beams forming the aforementioned loop are integrated as a part of the walls/roof of the car box. A problem of solutions according to prior art is, inter alia, that the high and wide ridge-shaped overall structure of the upper horizontal beam system with the components connected to it has resulted in the forming of standing platforms to the sides of the structure in question. The platforms on the sides are at a distance from each other and between them is a horizontal beam system causing a risk of stumbling. Driving an elevator car on service drive has in these solutions had to be performed while standing on a side of the elevator car near the stationary parts of the elevator hoistway and near the path of movement of a possible counterweight.

Known also in the art are frames, the upper beam system of which is formed from two horizontal beams, which are near each other and between which the elevator roping travels for achieving a central suspension. This type of technology is presented in, among others, publications EP1970341B1, U.S. Pat. No. 5,957,243. In these types of solutions the beam systems are near each other, the spaces between them are cramped and the elevator components effectively fill them. In these types of solutions the working platforms are formed on the outer sides of a high and wide upper horizontal beam system, and crossing over, crossing under or otherwise steeping onto the point of the upper horizontal beam system is a safety risk.

Also known in the art, e.g. from publication U.S. Pat. No. 6,202,801B1, is a solution wherein the roof of the elevator car can be opened, in which case a serviceman can, while standing on a raisable platform on the elevator car, service the components of the elevator hoistway. The space needed by a workman does not in this case extend to high above the car, and working in the center area of the car is possible, but one problem is the complex structure because the roof needs to be opened for enabling servicing.

AIM OF THE INVENTION

The aim of the invention is to eliminate, among others, the aforementioned drawbacks of prior-art solutions. More particularly the aim of the invention is to produce an elevator, the roof structure of the elevator car of which is compact in the vertical direction, and in which a serviceman can work on the roof of the elevator car more safely than before. The aim of the invention is further to produce one or more of the following advantages, among others:

- An elevator is achieved, in which a standing surface for a serviceman is very close to the downward facing roof surface bounding the interior of the elevator car. In other words, the structural thickness between the interior of the elevator car and the standing platform is small and the parts of a serviceman that extend to highest above the elevator car, more particularly the head, can be kept as low as possible while working on the roof, e.g. when driving on service drive. The space needed by a serviceman does not therefore extend to high above the interior of the elevator car.
- Servicing procedures, e.g. a service drive, can be performed safely standing at a distance from the edges of the elevator car.
- An elevator is achieved, in which moving on the roof is freer and safer than before, e.g. moving from one edge to another.
- An elevator is achieved, on the roof of which the risk of stumbling is small.
- An elevator is achieved, the space usage of the roof structures of which is more efficient than before.
- An elevator is achieved, in which the distance of the standing platform on the roof of the elevator car from the roof of the elevator hoistway is large.
- An elevator is achieved, the distance between the downward facing surface bounding the interior of said elevator and the roof of the elevator hoistway is small when the elevator car is in its upper position.
- An elevator is achieved, the luminaires of which are easy to service.

SUMMARY OF THE INVENTION

The invention is based on the concept that the working space above an elevator car can be increased and formed for safer working on the roof of the car by forming the upper horizontal beam system of the elevator car to comprise two horizontal beams at a distance from each other and by arranging a trough between the horizontal beams, on the standing platform on the base of which trough a person fits to stand. In this case it is possible to stand on the roof between the beams, because the feet extend to the trough below the level of the top surfaces of the beams.

In one basic embodiment of the concept according to the invention the elevator comprises an elevator hoistway, and an elevator car arranged to move in the elevator hoistway, which elevator car comprises

- an interior, which is bounded at least by the ceiling of the elevator car, and
- a frame structure, which comprises two parallel, horizontal, elongated roof beams in connection with the roof of the elevator car that are at a horizontal distance from each other, between which roof beams is a trough that has an upward-facing base surface, and a standing platform in connection with the roof of the elevator car, which standing platform comprises a standing surface a, immediately above which is a space free of the parts of the elevator car and free of the ropes of the elevator, for enabling standing on top of the aforementioned standing surface at least when the elevator car is situated at a distance from the top end of the elevator hoistway, which standing surface forms at least a part of the base surface of the trough. In this way the aforementioned advantages are achieved.

In a more refined embodiment of the concept according to the invention the surface area of the aforementioned standing surface a is at least 0.09 square meters, preferably at least 0.1 square meters, most preferably at least 0.12 square meters or more. Thus the standing surface is of a size that enables safe working on top of it.

In a more refined embodiment of the concept according to the invention the width of the aforementioned standing surface (the transverse direction of the trough) is 250 mm or more, more preferably 300 mm or more. Thus a safety shoe fits transversely into the trough.

In a more refined embodiment of the concept according to the invention the length of the aforementioned standing surface (a) (the longitudinal direction of the trough) is at least 400 mm or more, preferably at least 500 mm. Thus a safety shoe fits into the trough in the longitudinal direction. Likewise the vertical projection of a person can fit in this direction inside the standing surface.

In a more refined embodiment of the concept according to the invention the aforementioned standing surface is rectangular in shape and at least 0.09 square meters, preferably at least 0.1 square meters, preferably more, most preferably at least 0.12 square meters or more in surface area. The shortest side of the rectangle is 250 mm or more, more preferably 300 mm or more. Thus the vertical projection of a person can fit inside the standing surface.

In a more refined embodiment of the concept according to the invention the aforementioned free space immediately above the standing surface extends in the shape of a standing surface in its cross-section directly upwards from between the roof beams for a distance of at least 1.8 m at least when the elevator car is situated at a distance from the top end of the elevator hoistway. Thus it is possible to stand up straight on the standing surface, e.g. on service drive when the car is at a distance from the top end of the hoistway.

In a more refined embodiment of the concept according to the invention the standing surface a is at a distance from all the edges of the elevator car, preferably such that it covers the point X, which is at the center of the car as measured in the longitudinal direction of the roof beams and in the center of the distance between the roof beams as measured in the transverse direction. Thus working in the center area of the elevator car is possible, e.g. driving the car on service drive at a distance from the parts moving in relation to the car that are in the proximity of the edges of the car.

In a more refined embodiment of the concept according to the invention the elevator car is suspended with hoisting roping, which is connected to the elevator car such that it is apart from the trough. The roping is thus not guided via the trough, which enables the formation of the trough into a free space enabling a person to be on it. Likewise the space above the trough is free of the suspension means of the hoisting roping.

In a more refined embodiment of the concept according to the invention the elevator car is suspended with hoisting roping, which is connected to the elevator car with means (such as via a diverting pulley system or equipment for fixing the ropes), which are on the side of or below the elevator car. Thus the roping is apart from the free space arranged for standing. Thus also the maximum load to be exerted on the roof beams can be reduced, because the supporting of the structure and the load of the car does not need to be led via them. The roof structure can thus be formed to be very thin. The vertical bending resistance of each beam does not need to be very great.

In a more refined embodiment of the concept according to the invention immediately above the roof of the elevator car is a space free of the hoisting ropes of the elevator, which space is preferably at least 1.8 m high, at least when the elevator car is at a distance from the top end of the elevator hoistway. In this way, being on the roof is safe.

In a more refined embodiment of the concept according to the invention the elevator car is suspended with hoisting roping, which is connected to the elevator car such that it supports the elevator car via a diverting pulley system supported on the elevator car.

In a more refined embodiment of the concept according to the invention the elevator car is suspended with hoisting roping passing below the elevator car. Thus the hoisting roping can be simply arranged to travel apart from the trough and from the aforementioned free space.

In a more refined embodiment of the concept according to the invention the aforementioned roof beams are profile beams, preferably open channel profile beams such as C-profile beams, or closed profile beams, which profile beams have essentially the same continuous cross-sectional profile in the longitudinal direction of the beam, the width/height ratio of which cross-section is preferably at least 0.5, preferably 0.5-1, more preferably 0.7-0.9. The cross-sectional profile continues as such preferably for essentially the whole length of the beam. One advantage is a rigid structure, which is shallow, enabling large upper clearances and a low risk of stumbling.

In a more refined embodiment of the concept according to the invention each aforementioned roof beam is a profile beam piece, which has essentially the same continuous cross-sectional profile in the longitudinal direction of the beam, and which cross-sectional profile comprises at least one outer surface that faces obliquely upwards. Thus each roof beam comprises an elongated outer surface in its longitudinal direction, which surface is inclined in the direction of the side platform, and/or a surface which is inclined in the direction of the trough. An advantage is the reduced risk of stumbling.

In a more refined embodiment of the concept according to the invention each aforementioned roof beam is a profile beam piece, which has essentially the same continuous cross-sectional profile in the longitudinal direction of the beam, and the cross-sectional profile comprises at least one outer surface that faces obliquely upwards, which oblique surface connects the upward-facing horizontal outer surface and the sideward-facing vertical outer surface of the cross-sectional profile. The inclined surface is preferably a flat surface, and at least 15 mm wide. Thus the shape is simple and effective.

In a more refined embodiment of the concept according to the invention it comprises a side platform, which is preferably a standing platform, on the side of each roof beam, which side is on the opposite side to the aforementioned trough, which side platform comprises a horizontal top surface, which is preferably a standing surface, and which is essentially below the level of the top surfaces of the roof beams.

In a more refined embodiment of the concept according to the invention the aforementioned top surface of the side platform is essentially above the level of the bottom surface i of the roof beams. In this way the structure of the side platform is beside the beams and a compact structure is achieved.

In a more refined embodiment of the concept according to the invention each aforementioned roof beam together with its possible casing forms an elongated ridge between the side platform and the standing platform, which ridge extends to above the standing surface a of the standing platform and to above the horizontal top surfaces b of the side platforms, which surfaces are preferably also standing surfaces. In this way a durable frame structure is achieved at the same time, however, forming a large and safe working space above the elevator car, in which space moving is safe.

In a more refined embodiment of the concept according to the invention the elevator comprises a side platform, which is preferably a standing platform, on the side of each roof beam, which side is on the opposite side to the aforementioned trough, and that each aforementioned roof beam together with its possible casing forms an elongated ridge between the side platform and the standing platform, which ridge extends to above the standing surface a of the standing platform and to above the horizontal top surfaces b of the side platforms, which surfaces are preferably also standing surfaces, and that the aforementioned ridges p comprise the side surfaces of the trough.

In a more refined embodiment of the concept according to the invention it comprises a side platform, which is preferably a standing platform, on the side of each roof beam, which side is on the opposite side to the aforementioned trough, and that each aforementioned roof beam together with its possible casing forms an elongated ridge between the side platform and the standing platform, which ridge extends to above the standing surface a of the standing platform and to above the horizontal top surfaces b of the side platforms, which surfaces are preferably also standing surfaces, and that each aforementioned ridge comprises at least one elongated outer surface longitudinal to the ridge in question that faces obliquely upwards. Thus it is not tempting to step onto the ridge. Likewise the risk of stumbling on it is small.

In a more refined embodiment of the concept according to the invention each aforementioned ridge comprises a plurality of elongated outer surfaces longitudinal to the ridge in question that face obliquely upwards. In this way the aforementioned effects are more considerable.

In a more refined embodiment of the concept according to the invention each aforementioned ridge comprises an outer surface longitudinal to the ridge in question, said surface rising from the direction of the side platform beside it and facing obliquely upwards, which surface preferably rises towards the top surface of the beam, rising preferably to the proximity of the top surface of it, more preferably to above the top surface.

In a more refined embodiment of the concept according to the invention each aforementioned ridge comprises an outer surface longitudinal to the ridge in question, said surface descending towards the trough and facing obliquely upwards. Thus the risk of stumbling when moving out of the trough is low.

In a more refined embodiment of the concept according to the invention it comprises a casing plate, which extends to above the beam from the direction of the side platform, which casing plate comprises an outer surface longitudinal to the ridge in question, said surface rising from the direction of the aforementioned side platform towards the top surface of the roof beam and facing obliquely upwards. An inclined surface is thus simple to achieve. It can function at the same time as a casing plate of the casing, inside which casing components, such as a luminaire or an aforementioned roof beam, can be installed.

In a more refined embodiment of the concept according to the invention the frame structure comprises the aforementioned roof beams, the vertical beams of a first side and of a second side, and a floor beam system, which are connected to each other such that each of them forms a part of a ring-like frame structure, inside which is the interior of the elevator car.

In a more refined embodiment of the concept according to the invention the horizontal distance between the aforementioned horizontal roof beams (as measured from their parallel longitudinal sides that are nearest to each other at the point of the trough) is at most 700 mm, preferably at most 500 mm. Thus the roof beam structure is sufficiently rigid to function as a part of a ring-like frame structure.

In a more refined embodiment of the concept according to the invention the aforementioned roof beams are in their length such that they cover preferably at least most of the length of the elevator car.

In a more refined embodiment of the concept according to the invention the aforementioned trough forms an elongated space essentially free of elevator components, which space preferably covers at least most of the length of the elevator car.

In a more refined embodiment of the concept according to the invention the standing platform is fixed to the aforementioned roof beams. Thus the standing platform is firmly positioned and withstands standing and at the same time stiffens the frame structure.

In a more refined embodiment of the concept according to the invention the standing platform of the elevator car comprises a plate, which is fixed to the aforementioned roof beams, which plate comprises the aforementioned standing surface a. In this way the structure can be formed to be simple. The plate is preferably a bent metal plate.

In a more refined embodiment of the concept according to the invention the standing platform comprises a metal plate, which is fixed to the aforementioned roof beams for connecting them rigidly to each other, and that the aforementioned plate extends horizontally from the first roof beam up to the second roof beam for at least most of the distance of the length of the roof beams. Thus the structure is durable and the stiffening effect of the frame structure is considerable.

In a more refined embodiment of the concept according to the invention the aforementioned standing surface a is below the top surfaces of the roof beams and above their bottom surfaces. Thus the plate/panel bounding the interior can be supported against the roof beams, or at least near to them, and an air gap can still be left between the plates.

In a more refined embodiment of the concept according to the invention the standing platform, more particularly the aforementioned plate, comprises a horizontal bottom surface a', which is essentially above the level of the bottom surfaces of the roof beams. Thus the structure is compact in the vertical direction because the trough can be formed without taking the interior space of the car and at the same time the frame can be stiffened.

In a more refined embodiment of the concept according to the invention the standing platform comprises a horizontal section, which forms the aforementioned base surface of the trough, and comprises the aforementioned surface a, and sections rising to above the base surface, the surfaces of which sections form the side surfaces of the aforementioned trough. Thus the shapes of the trough are easy to form e.g. from a metal plate by bending. Also the fixing is simple to arrange. The rigidity effect of the frame can thus also be formed to be considerable.

In a more refined embodiment of the concept according to the invention the elevator, more particularly the standing platform, comprises a plate, which comprises a horizontal section, which forms the base surface of the aforementioned trough d, and comprises the aforementioned surface a, and rising sections supported against the side surfaces o of the roof beams 2, the surfaces of which sections form the side surfaces of the aforementioned trough d. The rigidity effect of the frame can thus be formed to be considerable.

In a more refined embodiment of the concept according to the invention the plate further comprises sections extending to above the roof beams, which sections comprise bottom surfaces that are placed against the top surfaces of the roof beams. Thus the plate is in the vertical direction simply supported in its position and withstands well the vertical loading to be exerted on the surface a.

In a more refined embodiment of the concept according to the invention the elevator car further comprises a cover plate below the aforementioned plate, which cover plate comprises a bottom surface, which forms a surface bounding the interior, and that the bottom surface a' of the plate and the top surface n' of the cover plate are at a vertical distance from each other such that a space is formed between them, in which space air between the interior and the elevator hoistway or electricity cables is/are preferably led to travel. In this way the space of the roof of the elevator car can be efficiently utilized. Likewise the reversible bending of the plate becomes possible without bending the cover plate.

In a more refined embodiment of the concept according to the invention the cover plate is supported against the aforementioned roof beams from below, which plate comprises a bottom surface, which forms a surface bounding the interior. Thus the structure is very compact.

In a more refined embodiment of the concept according to the invention the elevator comprises one or more luminaires for lighting the interior of the elevator car.

In a more refined embodiment of the concept according to the invention the structure of the aforementioned at least one luminaire, preferably at least the light source and/or the reflective surface of the luminaire, is at least partly, preferably fully, beside the roof beam (i.e. in the vertical direction at the point of the roof beam). Thus the structure is very compact.

In a more refined embodiment of the concept according to the invention the structure of the aforementioned at least one luminaire, preferably at least the light source and/or the reflective surface of the luminaire, extends to above the level of the aforementioned standing surface a. Thus the structure is very compact.

In a more refined embodiment of the concept according to the invention it comprises one or more of the aforementioned luminaires on the side of each beam, which side is on the opposite side to the aforementioned trough. In this way the desired width of the trough and distance between roof beams can be achieved, which enables a rigid structure.

In a more refined embodiment of the concept according to the invention the aforementioned roof beam forms a part of the inner wall of the casing, into which casing a luminaire is disposed, preferably forming at least a part of the inner surface of the inner wall of the casing. Thus the structure is compact.

In a more refined embodiment of the concept according to the invention the roof beam is a channel profile open to the side, into the channel side of which profile the aforementioned at least one luminaire is disposed. Thus the structure is compact.

In a more refined embodiment of the concept according to the invention the elevator comprises one or more luminaires, which are at least partly inside the ridge. Thus the structure is compact.

In a more refined embodiment of the concept according to the invention the elevator comprises a casing plate, which extends to above the roof beam from the direction of the side platform. In this way the casing plate withstands impacts directed at it. Likewise the casing plate can conceal the roof beam. When the material thickness of the roof beam is large, a high sill is not formed.

In a more refined embodiment of the concept according to the invention the aforementioned casing plate forms at least a part of the inner wall of the casing, into which casing the aforementioned luminaire, and preferably also at least partly the roof beam, are disposed.

In a more refined embodiment of the concept according to the invention it comprises a casing plate, which forms at least a part of the inner wall of the casing, into which casing the aforementioned luminaire is disposed, and that the casing plate is arranged to be opened from above the roof of the car, for servicing, replacing or installing a luminaire. Thus there is access to a luminaire from the roof.

In a more refined embodiment of the concept according to the invention the width of the aforementioned ridge is at most 200 mm, preferably at most 150 mm. Thus crossing it does not cause a hazard.

In a more refined embodiment of the concept according to the invention the aforementioned frame structure also comprises the vertical beam(s) of a first side and the vertical beam(s) of a second side, between which is the aforementioned interior, and which beams are rigidly connected to each other by means of the aforementioned roof beams.

In a more refined embodiment of the concept according to the invention the frame structure comprises horizontal floor beams, above which is the aforementioned interior and which beams rigidly connect the aforementioned vertical beams and on which beams means, such as diverting pulleys or rope clamps, for connecting the hoisting ropes to the elevator car are supported.

In a more refined embodiment of the concept according to the invention the cross-sectional profile of each roof beam 2 comprises a horizontal top surface j, the width of which is at least 20 mm. Thus good rigidity and a shallow structure are obtained from a roof beam.

In a more refined embodiment of the concept according to the invention neither of the ridges on the sides of the trough comprise an elongated horizontal top surface over 70 mm wide, preferably such that neither of the ridges (p) on the sides of the trough comprise an elongated horizontal top surface over 50 mm wide. In this way the temptation of lowering goods onto them or stepping onto them is small.

Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments. Each of the additional features mentioned by a preceding embodiment can also singly and separately from the other embodiments form a separate invention.

LIST OF FIGURES

In the following, the invention will be described in detail by the aid of some examples of its embodiments with reference to the attached drawings, wherein FIG. 1 diagrammatically presents an elevator according to the invention.

Figure 2:
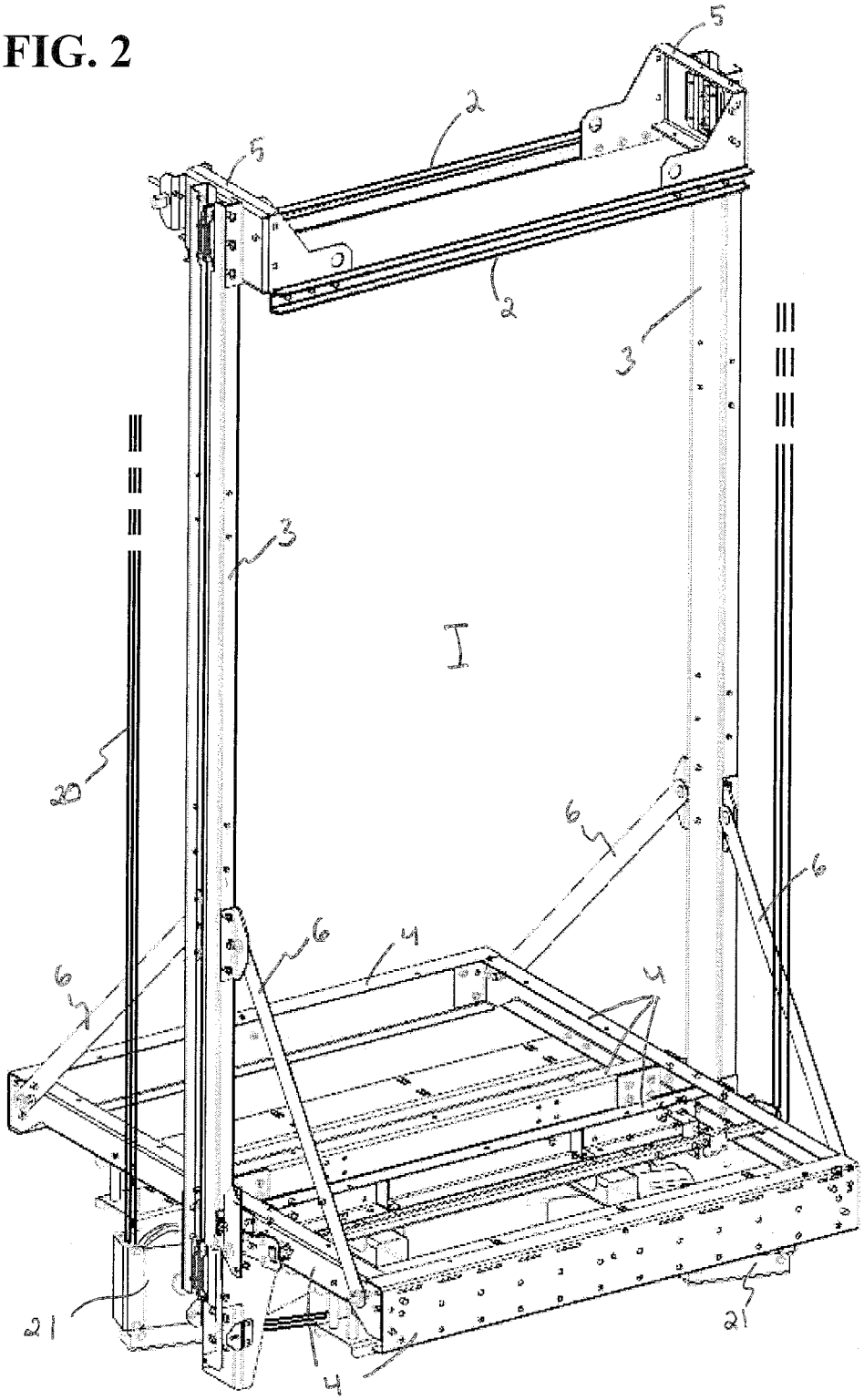

FIG. 2 presents the frame structure of an elevator car of an elevator according to the invention.

Figure 3:
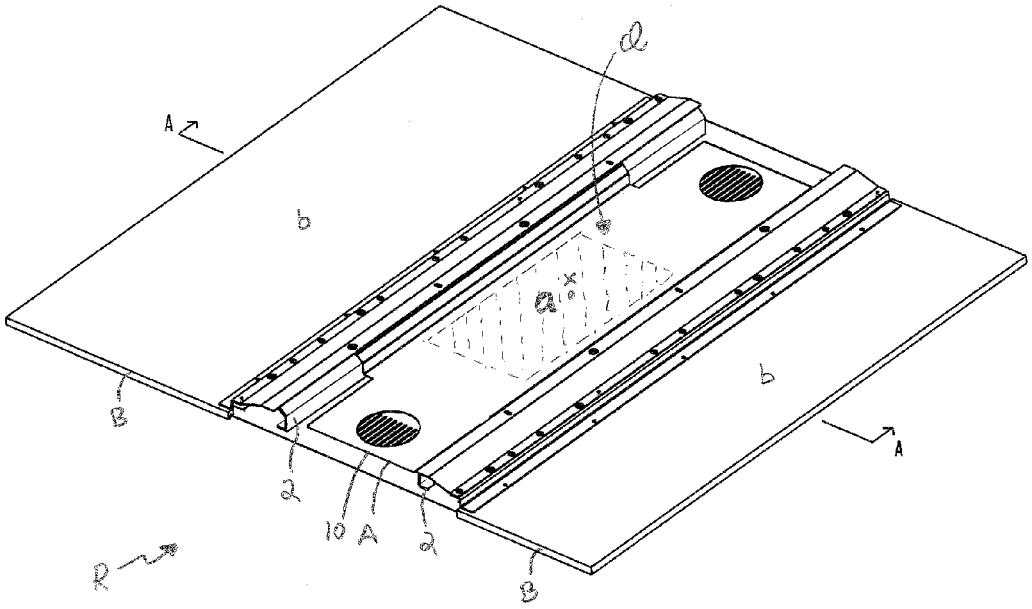

FIG. 3 presents the roof of an elevator car of an elevator according to the invention.

Figure 4:
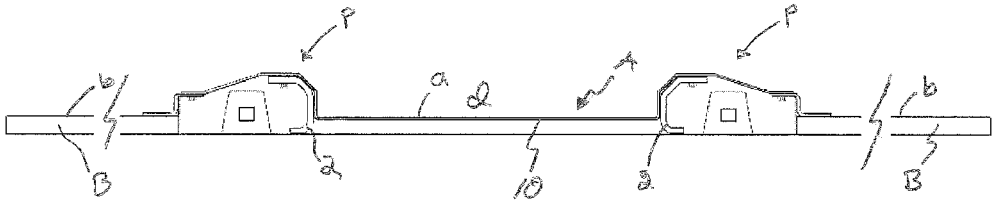

FIG. 4 presents a cross-section A-A of the roof of FIG. 3 of the invention.

Figure 5:
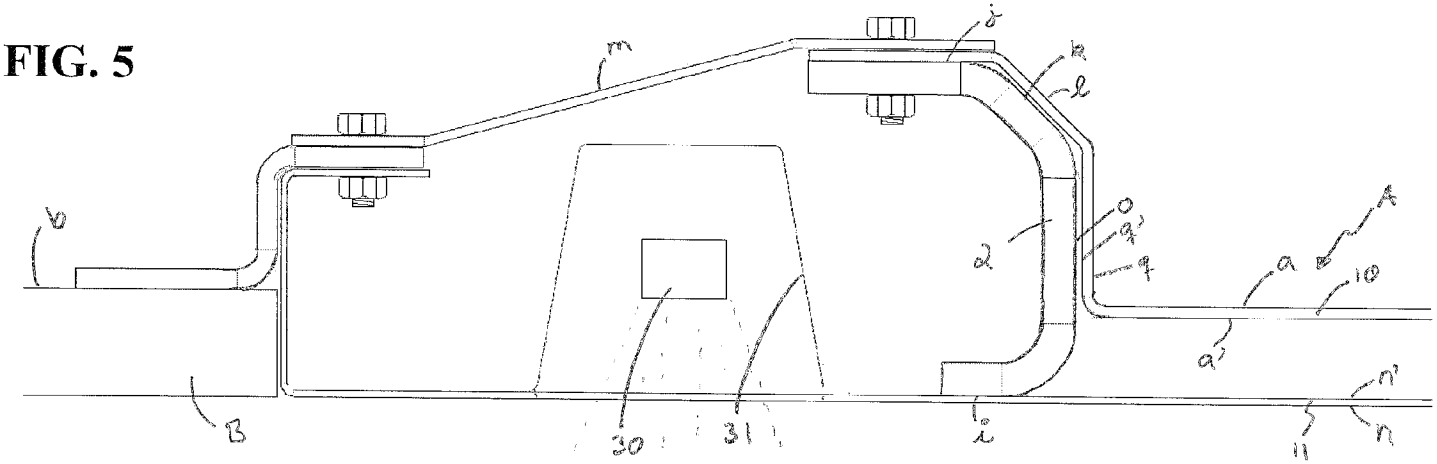

FIG. 5 presents a detail of the cross-section A-A of FIG. 3.

Figure 6:
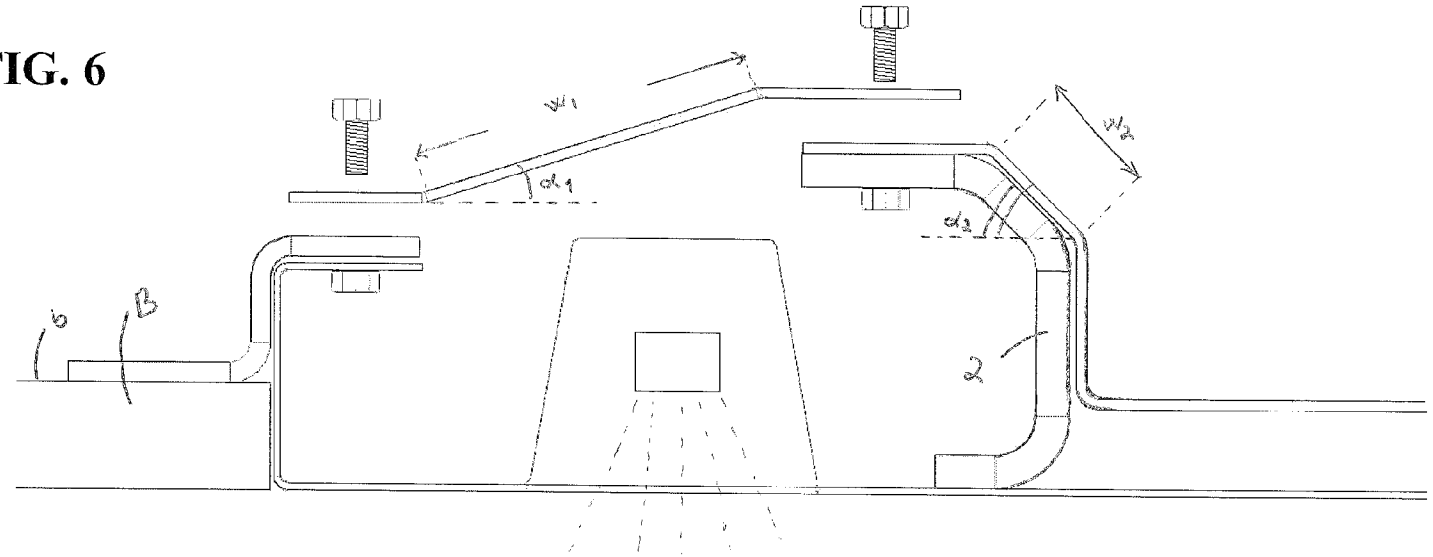

FIG. 6 presents the structure of FIG. 5 when the casing is opened.

DETAILED DESCRIPTION OF THE INVENTION

FIG. 1 presents an elevator according to the invention, which elevator comprises an elevator hoistway S, and an elevator car 1 arranged to move in the elevator hoistway, which elevator car 1 comprises an interior I, which is bounded by the walls, roof, floor and door of the elevator car. The elevator car is moved with a hoisting machine M via hoisting ropes 20.

The elevator car 1 comprises a frame structure, which comprises two parallel, horizontal, elongated roof beams 2 in connection with the roof R of the elevator car 1, said beams being integrated as a part of the structure of the roof and at a horizontal distance from each other, between which roof beams 2 is an upward-opening elongated trough d, which comprises an upward-facing base surface and side surfaces. The trough d is the space between the beams, which space has a base surface, which is essentially (preferably at least 30 mm, more preferably more) lower than the top surfaces j of the roof beams 2. For enabling standing in the trough, the standing surface a of the platform A comprised in the elevator car is arranged to form at least partly the aforementioned base surface (i.e. the whole standing surface a is at least a part of the aforementioned base surface of the trough d). The platform A must be fitted to support a person on the standing surface a without breaking. Furthermore, for enabling standing in the trough d, the trough d is essentially empty of elevator components. In this case immediately above the standing surface a is a space free of the parts of the elevator car 1 and free of the ropes of the elevator. The free space extends in the shape of the standing surface a to suitably high above the standing surface a between the roof beams 2. It is possible in this case to stand on top of the standing surface a without obstruction from the elevator car or from the parts moving along with it at least when the elevator car 1 is located at a suitable distance from the end of the elevator hoistway S, e.g. when driving on service drive or when the car has been stopped at a distance from the end of the hoistway or if the top clearances are spacious when the car is in its top position.

The width of the standing surface a of the standing platform A (the transverse direction of the trough d) is 250 mm or more, more preferably 300 mm or more, so that standing on the surface a in the trough would be safe and would enable working. For this purpose, the horizontal distance between the aforementioned horizontal roof beams (as measured from their parallel longitudinal sides that are nearest to each other) must be set to be suitable, at least to be the same as the width of the aforementioned standing surface a, in which case the horizontal distance of them is correspondingly also at least 250 mm, preferably at least 300 mm. The horizontal distance between the aforementioned horizontal roof beams 2 (as measured from their parallel longitudinal sides that are nearest to each other at the point of the trough) is, however, preferably at least 700 mm, preferably at most 500 mm, for achieving a suitably rigid frame structure. The surface area of the aforementioned standing surface a is at least 0.1 square meters, preferably more, most preferably at least 0.12 square meters. The length of the standing surface a in the longitudinal direction of the roof beams 2 is preferably over 400 mm, more preferably over 500 mm. The aforementioned standing surface a is most preferably a rectangular area, the surface area of which is at least 0.1 square meters, preferably more, most preferably at least 0.12 square meters. The shortest side of the rectangular area is preferably the aforementioned at least 250 mm, more preferably at least 300 mm. The standing surface a is preferably situated at a distance from the edges of the elevator car, preferably such that it covers the point X, which is at the center of the car as measured in the longitudinal direction of the roof beams 2 and in the center of the distance between the roof beams 2 as measured in the transverse direction.

FIGS. 2-4 present more precisely the structural details of an elevator according to FIG. 1. The elevator car 1 comprises a frame structure (2,3,4,5,6) of the type presented in FIG. 2, which is a load-bearing structure, and is thus suited to bearing most of the forces exerted on the elevator car (1). FIG. 3 presents the structure of the roof R, which structure can be fixed to another frame structure by fixing the roof beams 2 via the parts 5 to the vertical beams 3. The frame structure (2,3,4,5,6) comprises, as presented in FIG. 2, two parallel, horizontal, elongated roof beams 2 at a horizontal distance from each other, as well as the vertical beams 3 of a first side and of a second side, and a floor beam system 4, which are connected to each other such that each of them forms a part of a ring-like frame structure, inside which is the interior I of the elevator car. The roof beams 2 are rigidly connected to the vertical beams 3 via the frame parts 5, which support the roof beams 2 at a distance from each other. The frame parts 5 comprise spacer sections extending towards the sides, which sections are fitted to position the roof beams 2 at a greater distance from each other than if they were directly connected to the vertical beams 3. The aforementioned two roof beams 2 are integrated as a part of the structure of the roof such that they form a part of the roof structure bounding the interior. Wall paneling, a floor and/or ceiling paneling, which is/are not presented in FIG. 2, can be fixed to the frame structures (2,3,4,5,6) presented. The ceiling paneling can be seen in FIG. 3 and describing the structure of the roof R. The plate 10 comprised in the elevator car can also be counted as a part of the frame structure, which plate connects the beams 2 to each other (presented in FIG. 3, among others), and which plate is fixed from a number of points to the beams and stiffens the frame structure, and which plate forms the aforementioned standing platform A and comprises the aforementioned standing surface a.

The elevator car 1 is suspended with hoisting roping 20, which is connected to the elevator car 1 such that it passes at a distance from the trough d. For this purpose the roping 20 presented in FIG. 1 suspends the elevator car 1 from elsewhere than from above the trough d. The suspension is implemented via the diverting pulley system 21, which diverting pulley system is supported on the frame at a distance from the aforementioned trough such that the diverting pulley system, or the part of the roping 20 arriving at it or leaving from it, does not travel above the base of the trough d. For this purpose the diverting pulley system 21 is supported below the level of the roof of the elevator car, on the floor beam system 4 of the elevator car such that the hoisting roping 20 passes below the elevator car 1. The hoisting roping 20 could also otherwise suspend the car 1 without it traveling a disadvantageous route in this respect. For example, the suspension of the elevator could be arranged by fixing the diverting pulley systems to the side of the car, to the beams 3, or by suspending the car with a 1:1 solution and by fixing the ends of the ropes to the sides of the car.

The elevator car 1 comprises, in addition to the platform A, a side platform B, which is preferably a standing platform, on the side of each roof beam 2, which side is on the opposite side to the aforementioned trough d, and which side platform B comprises a horizontal top surface b, which is thus preferably a standing surface, and which is essentially below the level of the top surfaces j of the roof beams 2, preferably at the same level as the surface a. As presented in the figure, the roof beams 2 are covered with casing, but the casing is not necessary. Each aforementioned roof beam 2 together with its possible casing forms an elongated ridge p between the side platform B and the standing platform A, which ridge extends to above the side platform B and the standing platform A. There are thus two ridges p and they are parallel. Between the ridges is the aforementioned trough and a ridge comprises the side surfaces (q) of the trough d. In this way a durable frame structure is achieved at the same time, however, forming a large and safe working space above the elevator car. The upper horizontal beam system of the frame of the elevator car 1 is, instead of being one large beam, in this way divided into two smaller beams, which have been taken so far apart from each other, and the space between them made so free of elevator components that a person fits to stand between them, which is further enabled by forming the surface a of the platform A to withstand standing. With these solutions moving on the roof is also safer than before because the ridges formed by the roof beams are not high and it is possible to move to between them with a shallow step without stumbling. Moving from the first platform B to the second platform B can thus also be safely performed via the platform A by taking an intermediate step onto the platform A. FIGS. 5 and 6 present in more detail the structure of the ridge p, which structure is similar in both ridges but symmetrically a mirror image on the different sides of the trough. For further improving the safety of working on the roof, each ridge p comprises an elongated outer surface (l,m) that is longitudinal to the ridge in question and that faces obliquely upwards. The aforementioned inclined surface l,m continues for at least most of the length of the ridge p, preferably for the whole length at the point of the standing surface a. The ridge thus comprises an elongated outer surface m in its longitudinal direction, which surface is inclined in the direction of the side platform, and an elongated outer surface l in its longitudinal direction, which surface is inclined in the direction of the trough. For achieving improved safety, both of these (l,m) do not necessarily need to be inclined. An inclination reduces the temptation of stepping onto a ridge or of using a ridge as a lowering base. Further, it is advantageous that each aforementioned ridge p comprises an aforementioned surface m that faces obliquely upwards and that rises from the direction of the side platform. Thus the surfaces m rise at least essentially to the level of, and preferably also over, the top surfaces of the beams 2, in which case the casing plate 15 comprising the surface m can guide a foot coming from the side direction over the beam 2 fully without a risk of stumbling. Further, it is advantageous that each ridge p comprises, as also presented in the figures, an outer surface l longitudinal to the ridge in question, said surface descending towards the trough and facing obliquely upwards. Thus when moving from the platform A to the side platform B the risk of a foot tripping is very small, because the inclined surface l guides the foot over the ridge 2. The angle alfa1, alfa2 of the aforementioned inclined surfaces with respect to the horizontal direction is preferably over 15 degrees, but below 60 degrees, more preferably 20-50 degrees. The width (w1,w2) of the inclined surface l,m is preferably at least 15 mm, more preferably at least 20 mm, in which case the intended effect is significant. Each ridge p comprises essentially the same continuous surface profile in its longitudinal direction, which surface profile preferably continues essentially the same for most of the length of the car in the longitudinal direction of the ridge. This surface profile comprises the aforementioned outer surface(s) l,m that face (s) obliquely upwards.

The roof beams 2 are essentially similar and parallel beams that are on the same level. The roof beams 2 are placed as mirror images of each other (in opposite attitudes) on different sides of the trough such that they are stationed essentially symmetrically around the trough. The roof beams 2 presented are asymmetrical, but if desired the roof beams could also themselves be symmetrical, such as, for instance, O-beams or rectangular pipes. The standing platform A is formed from a plate 10, preferably from a metal plate, which, in respect of its internal structure and its fixings, withstands someone standing on top of the top surface it comprises without breaking. The plate comprises a standing surface a, which is the top surface of the plate, and a bottom surface a'. Partly for enabling standing in the trough and generally for achieving an intensely compact structure, the standing surface a is essentially below the level of the top surfaces j of the roof beams 2. The surface a is preferably above the level of the bottom surfaces i of the roof beams 2. The plate 10 is in this case preferably placed such that the aforementioned bottom surface a', which is horizontal, is essentially flush with the bottom surfaces i of the roof beams 2, or above the level of them, and extends horizontally from a first roof beam 2 up to a second roof beam 2. Thus the plate 10 comprises a horizontal section, which forms the aforementioned base surface of the trough d, and comprises the aforementioned surface a forming a horizontal stiffener between the roof beams 2. Thus the plate 10 prevents the beams 2 from buckling and effectively prevents them from moving closer to each other by forming a compression resistance. The plate 10 is supported with this type of cross-section, which preferably continues for most of the distance of the beams 2. The plate further comprises sections extending to above the roof beams, which sections comprise bottom surfaces that are placed against the top surfaces of the roof beams. In addition, the plate 10 is preferably fixed to the roof beams for most of the distance of the roof beams 2 (preferably with a plurality of fixings at intervals), so that it forms an effective stiffener between the roof beams 2, also resisting movement of the beams away from each other. For the purposes of the fixing, the plate 10 closely follows the surface of each beam on the trough d side and rises and bends along with the surface of the beam to on top of the beam 2. The plate 10 thus rests on top of the roof beams. The bottom surface a' of the plate 10 bends upwards and leans against the vertical surface o of the roof beam 2. In this way an extensive contact surface is formed between the plate 10 and the beam 2, and the plate 10 effectively prevents the beams 2 from moving closer to each other. The surfaces q of the rising sections (facing the side of the standing platform) of the plate 10 supported against the side surfaces o of the beams 2 in this case form the side surfaces of the trough d. The installation platform A could also be otherwise supported in its position, e.g. by welding it to the roof beams 2. In this case the sides o of the roof beams could form the side surfaces for the trough.

The fixing to the beam can be from above or from the side from the direction of the trough d, which fixing is made with a plurality of fixings, such as with a plurality of bolt fixings or corresponding. The elevator car 1 further comprises a cover plate 11 below the aforementioned plate 10, which cover plate comprises a bottom surface n, which forms a surface bounding the interior (I), and the bottom surface a' of the plate 10 and the top surface n' of the cover plate 11 are at a vertical distance from each other such that a space is formed between them. The space allows reversible bending of the plate 10 when standing on top of it. Another advantage is also that in the space air can be conducted into the elevator car or out of it, or wires can be disposed in the space. The cover plate 11 is supported against the aforementioned roof beams 2 from below. With the structure presented, the distance between the surface a and the surface n can be formed to be very small.

The roof beams 2 are profile beams, preferably open C-profile beams as presented in the figures, but they could alternatively be closed profile beams. The roof beams have essentially the same continuous cross-sectional profile in the longitudinal direction of the beam (for at least essentially the whole length of the beam), the width/height ratio of which cross-section is preferably at least 0.5, preferably 0.5-1, more preferably 0.7-0.9. In this way the rigidity of them can be fitted to be sufficient without the height being great, in which case with regard to them they can be crossed without a stumbling risk. They are preferably of metal in their material. The cross-sectional profile of each roof beam 2 comprises a top surface j and a bottom surface i, which therefore when the profile is continuously the same, form an elongated top surface j and an elongated bottom surface i. The cross-sectional profile of each roof beam 2 preferably comprises, as is seen from the figures, an outer surface k that faces obliquely upwards, which oblique surface connects the upward-facing horizontal top surface j and the sideward-facing vertical outer surface 0 of the cross-sectional profile. The inclined surface k is preferably a flat surface, and at least 12 mm, preferably at least 15 mm wide. Thus the risk of stumbling is small also when the structure is without a casing. The roof beam 2 is in this case preferably placed as presented in the figures such that the longitudinal elongated outer surface k faces to the side of the trough d, but could also be placed such that the oblique surface faces to the side of the side platform or forms the beam to be such that one oblique surface faces obliquely to both sides.

The elevator car comprises one or more luminaires for lighting the interior I of the elevator car 1, the structure of at least one luminaire of which extends to above the level of the aforementioned standing surface a. It comprises in this case the aforementioned one or more of the aforementioned luminaires on the side of each beam 2, which side is on the opposite side to the aforementioned trough d. FIGS. 5 and 6 present a cross-section of a ridge, which describes how a luminaire is disposed in connection with each ridge p, inside it. In this case the structure of the aforementioned at least one luminaire, preferably at least the light source 30 and possibly the reflective surface 31 of the luminaire, is beside the roof beam 2 in the vertical direction. The light source 30 can be a LED, in which case the reflective surface 31 is not necessary, or a fluorescent tube, in which case a reflective surface 31 is preferably present. With this structure a very compact overall structure is achieved. As presented in the figures, the aforementioned roof beam forms a part of the inner wall of the casing, into which casing a luminaire is disposed, forming at least a part of the inner surface of the inner wall of the casing. The roof beam is a channel profile open to the side, into the channel side of which profile at least one luminaire is disposed. In this way there is preferably a suitable amount of luminaires to cover essentially the length of each beam. As presented, the ridge p preferably comprises a casing, which comprises a casing plate 15. The casing plate 15, which forms a part of the inner wall of the casing of a luminaire, into which casing the aforementioned luminaire is disposed, can preferably be opened from above, from the roof of the car. Thus the servicing, replacement or installation of luminaires can be performed from the roof. The casing plate 15 extends from the direction of the side platform to preferably over the roof beam 2, and is fixed to it in an openable manner. The casing plate 15 is in this case a part fixed to the structure formed by the side platform B. If it is not intended to arrange servicing from above, the casing can be a fixed part of the structure forming the side platform B.

The aforementioned roof beams 2 are long beams, which are preferably such in their length that they cover preferably at least most of the length of the elevator car (as measured in the longitudinal direction of a roof beam). Also the aforementioned trough d preferably forms an elongated free space, which covers at least most of the length of the elevator car (measured in the direction of the trough). Preferably each ridge p extends to at most 50 mm above the aforementioned surface a and/or b. The width of the ridge is preferably at most 200 mm, preferably at most 150 mm. The horizontal top surface b comprised in the side platform B is preferably essentially above the level of the bottom surface i of the roof beams 2. In this way the structure of the side platform B is at least partly, preferably essentially wholly, beside the roof beams 2 and a compact structure is achieved. In this case also its bottom surface b', which preferably forms a downward-facing surface bounding the interior I of the car, can be brought upwards a lot for expanding the interior I of the car.

The ends of the trough d can, as presented, comprise ventilation apertures in the plate 10, via which apertures air can be moved between the interior I of the elevator car and the elevator hoistway S. It is not intended for a person to step into the area of the ventilation apertures, so that in this case the standing surface a forms only a part of the base surface of the trough d. In the area between the fan apertures the standing surface a preferably covers the whole width of the base surface of the trough d.

In this application, the term standing platform refers to a platform, which is fitted to endure a person (1000N) standing on top of the standing surface (a,b) comprised in the standing platform, which standing surface is an upward-facing horizontal top surface, without causing a permanent shape deformation.

It is advantageous to form the side platform B as a standing platform, in which case the aforementioned top surface b of the side platform B is a standing surface. The dimensions of the standing surface b and the free space above it preferably correspond to the dimensions of the surface a such that b meets the criteria for the standing surface a presented elsewhere in this application except that the free space above the standing surface b is not situated between the beams 2.

As stated above, the casing is not indispensable. The plate 10 does not necessarily need to reach to above the roof beams 2 in the manner presented. In this case the inclined surface k can deliver the function that was described as being delivered by the surface l.

It is obvious to the person skilled in the art that the invention is not limited to the embodiments described above, in which the invention is described using examples, but that many adaptations and different embodiments of the invention are possible within the frameworks of the inventive concept defined by the claims presented below.

The invention claimed is:

1. An elevator comprising:

an elevator hoistway having a top end; and an elevator car located in the hoistway, the elevator car comprising:

an interior, which is bounded by at least a ceiling of the elevator car;

a frame structure, which comprises two parallel, horizontal, elongated roof beams in connection with a roof of the elevator car that are at a horizontal distance from each other, between which elongated roof beams is a trough that has an upward-facing base surface, the roof of the car extending beyond the elongated roof beams away from the trough located between the elongated roof beams; and a standing platform in connection with the roof of the elevator car, which platform comprises a standing surface, immediately above which is a space free of parts of the elevator car and free of hoisting roping of the elevator, for enabling standing on top of the standing surface at least when the elevator car is situated at a distance from a top end of the elevator hoistway, wherein the standing surface forms at least a part of the base surface of the trough.

2. The elevator according to claim 1, wherein the elevator comprises a side platform on a side of each elongated roof beam, which side is on an opposite side to the trough, which side platform comprises a horizontal top surface, which is essentially below a level of top surfaces of the roof beams.

3. The elevator according to claim 2, wherein each elongated roof beam includes a casing that together form an elongated ridge between the side platform adjacent to the elongated ridge and the standing platform, which elongated ridge extends to above the standing surface of the standing platform and to above a horizontal top surface of each of the side platforms.

4. The elevator according to claim 3, wherein each elongated ridge comprises a plurality of elongated outer surfaces extending along a length of the elongated ridge that are oriented at an angle with respect to the horizontal top surface of the side platforms.

5. The elevator according to claim 3, wherein each elongated ridge comprises an outer surface extending along a length of the elongated ridge, said outer surface rising from a respective side platform and being oriented at an angle with respect to the horizontal top surface of a respective side platform.

6. The elevator according to claim 3, wherein each elongated ridge comprises an outer surface extending along a length of the elongated ridge, said outer surface descending towards the trough and being oriented at an angle with respect to the horizontal top surface of a respective side platform.

7. The elevator according to claim 3, wherein the elevator car comprises a casing plate, which extends to above at least one of the elongated roof beams from a respective side platform, which casing plate comprises an outer surface extending along a length of the elongated ridge, said outer surface rising from the respective side platform towards a top surface of the at least one elongated roof beam and being oriented at an angle with respect to the horizontal top surface of a respective side platform.

8. The elevator according to claim 1, wherein the elevator comprises a side platform on a side of each elongated roof beam, which side is on an opposite side to the trough, and in that each elongated roof beam includes a casing that together form an elongated ridge between the side platform adjacent to the elongated ridge and the standing platform, which elongated ridge extends to above the standing surface of the standing platform and to above a horizontal top surface of each of the side platforms, and in that the elongated ridge comprises at least one elongated outer surface extending along a length of the elongated ridge that is oriented at an angle with respect to the horizontal top surface of each of the side platforms.

9. The elevator according to claim 8, wherein the elevator car comprises one or more luminaires, which are at least partly inside one of the elongated ridges.

10. The elevator according to claim 1, wherein the elevator car comprises at least one luminaire for lighting the interior of the elevator car.

11. The elevator according to claim 10, wherein the at least one luminaire is beside one of the elongated roof beams.

12. The elevator according to claim 1, wherein the each elongated roof beam forms a part of an inner wall of a casing, into which casing a luminaire is disposed.

13. The elevator according to claim 12, wherein the elevator car comprises a casing plate, which forms at least a part of the inner wall of the casing, and the casing plate is arranged to be opened from above the roof of the car, for servicing, replacing or installing the luminaire.

14. The elevator according to claim 1, wherein the surface area of the standing surface is at least 0.09 square meter.

15. The elevator according to claim 1, wherein the standing surface is rectangular in shape and at least 0.09 square meter in surface area, and in that the shortest side of the rectangle is at least 250 mm.

16. The elevator according to claim 1, wherein the free space immediately above the standing surface extends in a shape of the standing surface in its cross-section directly upwards from between the roof beams.

17. The elevator according to claim 1, wherein the elevator car is suspended with hoisting roping, which is connected to the elevator car such that the hoisting roping is apart from the trough.

18. The elevator according to claim 1, wherein the elevator car is suspended with hoisting roping passing below the elevator car.

19. The elevator according to claim 1, wherein the elongated roof beams are profile beams having an open channel profile or closed profile, which profile beams have essentially a same continuous cross-sectional profile in a longitudinal direction of the profile beam, wherein a width/height ratio of which cross-sectional profile is at least 0.5.

20. The elevator according to claim 1, wherein the frame structure comprises the elongated roof beams, vertical beams of a first side and of a second side of the frame structure, and a floor beam system, which are connected to each other such that each of them forms a part of the frame structure such that the frame structure is ring-like, inside of which ring-like frame structure is the interior of the elevator car.

21. The elevator according to claim 1, wherein the standing platform is fixed to the elongated roof beams.

22. The elevator according to claim 1, wherein the standing platform of the elevator car comprises a plate, which is fixed to the elongated roof beams, which plate comprises the standing surface.

23. The elevator according to claim 1, wherein the two elongated roof beams are integrated in the roof such that they form a part of a roof structure that bounds the interior.

24. An elevator comprising:

an elevator hoistway having a top end; and an elevator car located in the hoistway, the elevator car comprising:

an interior, which is bounded by at least a ceiling of the elevator car;

a frame structure, which comprises two parallel, horizontal, elongated roof beams in connection with a roof of the elevator car that are at a horizontal distance from each other, between which elongated roof beams is a trough that has an upward-facing base surface; and a standing platform in connection with the roof of the elevator car, which platform comprises a standing surface, immediately above which is a space free of parts of the elevator car and free of hoisting roping of the elevator, for enabling standing on top of the standing surface at least when the elevator car is situated at a distance from a top end of the elevator hoistway, wherein the standing surface forms at least a part of the base surface of the trough, and, wherein the standing surface is below top surfaces, and above bottom surfaces, of the elongated roof beams.

25. An elevator comprising:

an elevator hoistway having a top end; and an elevator car located in the hoistway, the elevator car comprising:

an interior, which is bounded by at least a ceiling of the elevator car;

a frame structure, which comprises two parallel, horizontal, elongated roof beams in connection with a roof of the elevator car that are at a horizontal distance from each other, between which elongated roof beams is a trough that has an upward-facing base surface; and a standing platform in connection with the roof of the elevator car, which platform comprises a standing surface, immediately above which is a space free of parts of the elevator car and free of hoisting roping of the elevator, for enabling standing on top of the standing surface at least when the elevator car is situated at a distance from a top end of the elevator hoistway, wherein the standing surface forms at least a part of the base surface of the trough, and, wherein the elevator car comprises a side platform, a top surface of which is essentially above a level of bottom surfaces of the elongated roof beams.

* * * * *